United States Patent [19]

Lipp et al.

[11] 4,371,862

[45] Feb. 1, 1983

[54] VARIABLE RESISTANCE CONTROL

[75] Inventors: Ellis P. Lipp; Jay Utken, both of Frankfort, Ind.

[73] Assignee: Emhart Industries, Inc., Indianapolis, Ind.

[21] Appl. No.: 289,251

[22] Filed: Aug. 3, 1981

[51] Int. Cl.[3] ..... H01C 10/34

[52] U.S. Cl. ..... 338/174; 338/162

[58] Field of Search ..... 338/174, 162, 160, 307–309, 338/314

[56] References Cited

U.S. PATENT DOCUMENTS

| | | | |
|---|---|---|---|
| 2,101,441 | 12/1937 | Marston | 338/171 |
| 2,859,321 | 11/1958 | Garaway | 338/292 X |
| 3,581,265 | 5/1971 | Falco | 338/174 |
| 3,601,744 | 8/1971 | Zandman | 338/292 |
| 4,015,231 | 3/1977 | Seno et al. | 338/174 |

*Primary Examiner*—C. L. Albritton

*Attorney, Agent, or Firm*—Robert F. Meyer; D. W. Gomes

[57] ABSTRACT

A porcelain enamel steel substrate is used to carry a resistive path.

10 Claims, 2 Drawing Figures

VARIABLE RESISTANCE CONTROL

BACKGROUND OF THE INVENTION

Generally speaking, the present invention relates to an improved variable resistance control wherein an electrical resistance path and an electrical conductive strip are carried on a base and wherein movable electrical contact means electrically bridge the resistance path and the electrical conductive strip, the improvement comprising providing a backing means for the resistance path and connecting the same to the base, the backing means consisting essentially of a porcelain enamel steel.

Variable resistance controls are used in appliances such as televisions and stereos to vary their sound output. Such devices in general include a resistance path and an electrical conductive or collector strip carried on a base with a movable contact means bridging the resistance path and collector strip and connected to a knob so as to be rotated about the resistance path and collector strip to vary the output resistance of the device. One of the problems that has been found to be associated with such a device is that of dissipating heat from the substrate as the wattage rating of the control needs to be increased.

FEATURES OF THE INVENTION

It is, therefore, a feature of the present invention to provide a variable resistance control having a means to dissipate heat from a substrate which carries a resistance path of the control. Another feature of the invention is to provide such a device wherein a backing means is applied to the resistance path, the backing means including a porcelain enamel steel strip. Still another feature of the invention is the provision of such a control wherein the resistance path comprises a carbon based paint applied to the porcelain enamel steel strip. These and other features of the invention will become apparent from the following description taken in conjunction with the accompanying drawings.

Figure 1:
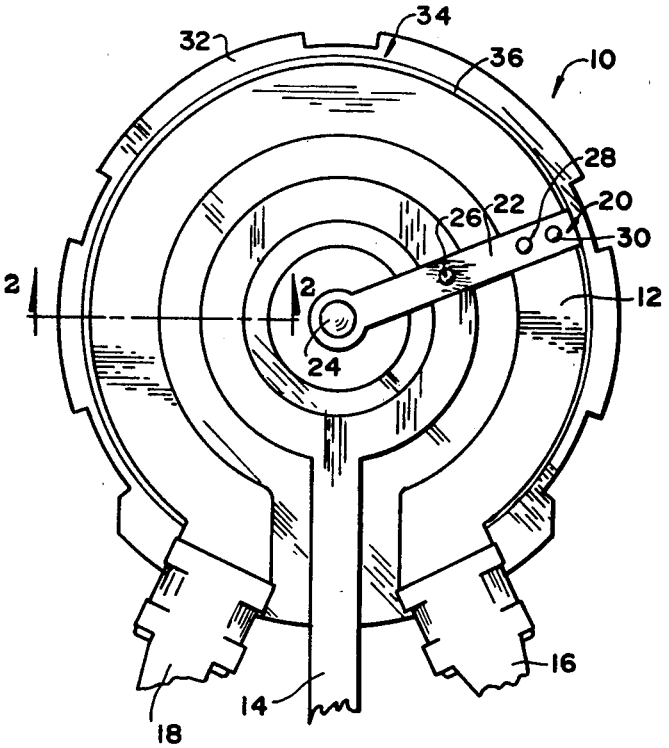
FIG. 1 is a plan view of a variable resistor showing the features of the invention.

Referring to the drawings, there is shown a variable resistor control 10 which in general includes a resistance path 12, a collector path 14, electrical terminals 16 and 18 connected to the resistance path, and an electrical contact means 20 electrically bridging the resistance path and the collector strip. Electrical contact means 20 includes an arm 22, connected to a rotatable shaft 24, the arm having an electrical contact 26 engaging collector strip 14 and electrical contacts 28 and 30 engaging resistance path 12. The resistance path and the collector strip are connected to a suitable base 32 by some suitable means such as staking the elements to the base. Thus far what has been described is well known in the art and thus is not described in detail. The whole unit would be carried in a housing, with electrical terminals 16 and 18 (including one for the collector strip) extending outside the housing.

Figure 2:
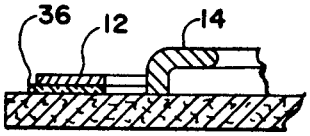
FIG. 2 is a section taken along the line 2—2 of FIG. 1.

As noted previously, with variable resistors of the type just described there is a problem with heat dissipation as the wattage of the resistor is increased. According to the present invention such problem is greatly reduced by providing an improved backing means 34 for resistance path 12. Referring to both FIGS. 1 and 2, backing means 34 includes a porcelain enamel steel strip 36 to which the resistive path 12 is applied. The resistive path may be applied to the strip by some suitable means; for example if the resistance path is of carbon, or silver based alloys such as silver-palladium, the path may be applied by silk screening, a photographic process, or other process well known in the art. An example of a suitable porcelain enamel steel would be one manufactured as PES Board by Erie Ceramic Arts Co. of Erie, Penn.

Tests have been conducted on variable resistors of the general type described, but with a resistance path of a different geometry. The resistance path was of a configuration which one might find in automotive applications where many variable resistances were needed. The resistance path consisted of a silver based palladium alloy which was silk screened onto a porcelain enamel steel backing. The path had a resistance of 4½ ohms. With 1.75 amperes of current applied for about 1 hour, the resistance path and the backing stabilized at a temperature of about 180° C. without any signs of substantial deterioration.

What is claimed is:

1. In a variable resistance control wherein there is an electrical resistance path and an electrical conductive strip and wherein movable electrical contact means electrically bridge the resistance path and the electrical conductive strip, the improvement comprising:

providing a backing means for said resistance path, said backing means consisting essentially of a porcelain enamel metal strip.

2. In a variable resistance control according to claim 1 wherein said metal is steel.

3. In a variable control according to claim 2 wherein said resistance path comprises carbon applied to said porcelain enamel steel.

4. In a variable resistance control according to claim 2 wherein said resistance path is a silver based palladium alloy.

5. In a variable resistance control according to claim 1 wherein said resistance path is silk screened onto said backing means.

6. A method of increasing the wattage potential of a variable resistance control wherein there is a resistance path and an electrical conductive strip and a movable electrical contact means bridges same, comprising:

(a) providing a backing means for said resistance path consisting essentially of a porcelain enamel metal strip.

7. A method according to claim 4 wherein said metal is steel.

8. A method according to claim 5 wherein said resistance path is carbon.

9. A method according to claim 4 wherein said resistance path is a silver based palladium alloy.

10. A method according to claim 6 wherein said resistance path is silk screened onto said backing means.

* * * * *

US004371862B1

REEXAMINATION CERTIFICATE (2675th)

United States Patent [19]

[11] B1 4,371,862

Lipp et al.

[45] Certificate Issued Sep. 19, 1995

[54] VARIABLE RESISTANCE CONTROL

[75] Inventors: Ellis P. Lipp; Jay Utken, both of Frankfort, Ind.

[73] Assignee: Emerson Electric Co., St. Louis, Mo.

Reexamination Request:
No. 90/003,319, Jan. 24, 1994

Reexamination Certificate for:

| | |
|---|---|
| Patent No.: | **4,371,862** |
| Issued: | **Feb. 1, 1983** |
| Appl. No.: | **289,251** |
| Filed: | **Aug. 3, 1981** |

[51] Int. Cl.[6] ..... H01C 10/34
[52] U.S. Cl. ..... 338/174; 338/162
[58] Field of Search ..... 338/172, 173, 174, 178, 338/200, 118, 125, 127, 160, 162, 163, 164

[56] References Cited

U.S. PATENT DOCUMENTS

| | | | |
|---|---|---|---|
| 3,576,510 | 4/1971 | Bruder | 338/150 |
| 3,644,865 | 2/1972 | Kirby et al. | 338/173 |
| 3,772,631 | 11/1973 | Owen | 338/195 |

OTHER PUBLICATIONS

The Erie Ceramic Arts Company, Porcelain Enameled Substrates for Thick Film Hybrids and PC Boards (1979).

Robert B. Schabacker, Porcelain Enameled Substrates for Hybrid Circuits and Printed Circuits (1979), pp. 3 and 7.

John Tsantes reference, Porcelainized-steel substrates gain favor for pc boards, hybrids, Electronic Design News (Jun. 20, 1980), p. 48.

*Primary Examiner*—Tu Hoang

[57] ABSTRACT

A porcelain enamel steel substrate is used to carry a resistive path.

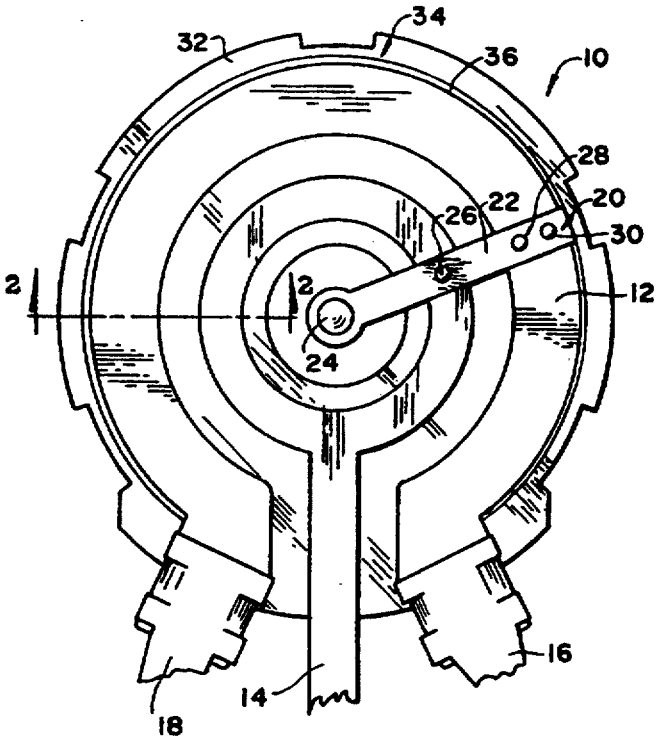

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–10 are cancelled.

* * * * *